US010951989B1

(12) United States Patent
Carr et al.

(10) Patent No.: US 10,951,989 B1
(45) Date of Patent: Mar. 16, 2021

(54) HEAD-WORN DEVICE WITH ADJUSTABLE HEADBAND CLAMP

(71) Applicant: Plantronics, Inc., Santa Cruz, CA (US)

(72) Inventors: Terry M Carr, Santa Cruz, CA (US); Xiaoyang Yu, Suzhou (CN)

(73) Assignee: Plantronics, Inc., Santa Cruz, CA (US)

( * ) Notice: Subject to any disclaimer, the term of this patent is extended or adjusted under 35 U.S.C. 154(b) by 0 days.

(21) Appl. No.: 16/548,541

(22) Filed: Aug. 22, 2019

(51) Int. Cl.
*H04R 5/033* (2006.01)
*H04R 1/10* (2006.01)

(52) U.S. Cl.
CPC ..... *H04R 5/0335* (2013.01); *H04R 1/1008* (2013.01); *H04R 1/1066* (2013.01)

(58) Field of Classification Search
CPC ..... H04R 1/10; H04R 1/1008; H04R 1/105; H04R 1/1058; H04R 1/1066; H04R 5/033; H04R 5/0335; H04R 2201/00; H04R 2201/10; H04R 2201/105; H04R 2201/109; H04R 2205/022
See application file for complete search history.

(56) References Cited

U.S. PATENT DOCUMENTS

2010/0189303 A1 7/2010 Danielson et al.
2012/0253252 A1* 10/2012 Weaver, II ..... A61F 5/34 602/20
2014/0263493 A1* 9/2014 Amurgis ..... H04R 1/105 224/181
2018/0302708 A1* 10/2018 Monaghan ..... H04R 5/0335

FOREIGN PATENT DOCUMENTS

CN 203289618 U 11/2013

* cited by examiner

*Primary Examiner* — Walter F Briney, III
(74) *Attorney, Agent, or Firm* — Chuang Intellectual Property Law

(57) ABSTRACT

Methods and apparatuses for headbands and head-worn devices are described. In one example, a headband includes a lace. The headband includes a tightenable apparatus disposed along a length of an inner side of the headband, the tightenable apparatus coupled to the lace and arranged to tighten or relax responsive to control of the lace. The headband further includes a cushion arranged to contact a wearer head.

14 Claims, 14 Drawing Sheets

HEAD-WORN DEVICE WITH ADJUSTABLE HEADBAND CLAMP

BACKGROUND OF THE INVENTION

Head-worn devices such as headphones and headsets often utilize a headband which is worn over the user's head. The headband operates to support and position the earphones worn on the user's ears. Head-worn devices may be worn in a variety of contexts, including situations where the user is in movement. For example, head-worn devices may be worn in both active activities (e.g., working out at the gym) and leisure activities. Furthermore, head-worn devices may be worn for extended periods of time. For these reasons, fit, stability, and comfort are all critical design considerations.

In the prior art, head-worn devices are typically either designed for active activities or leisure activities, but not both. Problematically, headphones designed for leisure activities, while comfortable, may not provide sufficient stability for active use. Conversely, headphones designed for athletic activities, while providing stability, may not provide sufficient comfort for extended wear leisure activities. As a result, improved methods and apparatuses for headbands for head-worn devices are needed.

BRIEF DESCRIPTION OF THE DRAWINGS

The present invention will be readily understood by the following detailed description in conjunction with the accompanying drawings, wherein like reference numerals designate like structural elements.

DESCRIPTION OF SPECIFIC EMBODIMENTS

Figure 1:
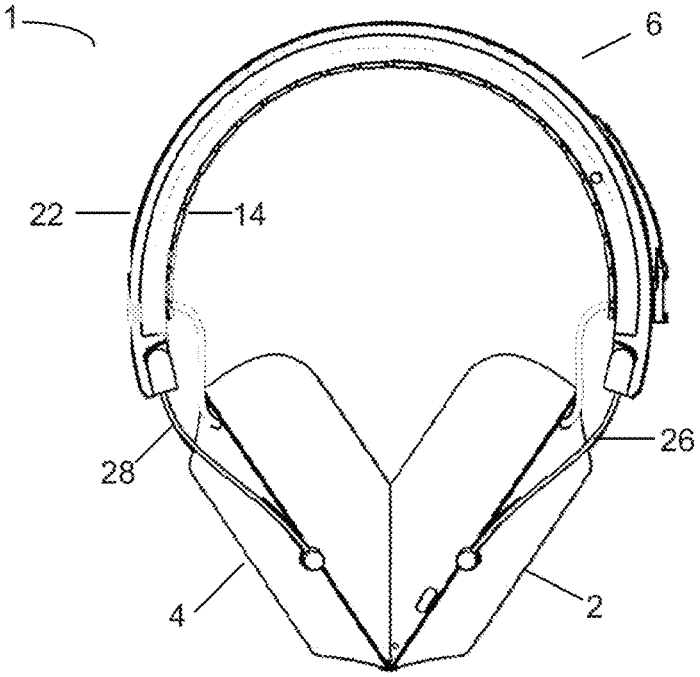
FIG. 1 illustrates a front view of a headphone having a tightenable apparatus in one example.

Methods and apparatuses for head-worn devices (e.g., headphones) and headbands are disclosed. The following description is presented to enable any person skilled in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus, the present invention is to be accorded the widest scope encompassing numerous alternatives, modifications and equivalents consistent with the principles and features disclosed herein.

For purpose of clarity, details relating to technical material that is known in the technical fields related to the invention have not been described in detail so as not to unnecessarily obscure the present invention. It is to be understood that various example of the invention, although different, are not necessarily mutually exclusive. Thus, a particular feature, characteristic, or structure described in one example embodiment may be included within other embodiments unless otherwise noted.

The headband apparatuses described herein advantageously provide both an active mode in which the headband is in a tightened state and a leisure mode in which the headband is in a relaxed state. During active mode, increased clamp force on the wearer head is provided in order to keep the head-worn device stable during wearer movement. In contrast, during leisure mode, clamp force is reduced to prioritize comfort. The clamp force of the headband is adjusted utilizing a lace user interface. The apparatuses and methods described solve the problem of stability versus comfort of head-worn devices across different activity types. As a further advantage, the use of a lace user interface provides a convenient, easy to understand, and easy to operate user interface.

In one example, a head-worn device includes a left earphone assembly, a right earphone assembly, and a headband. The headband has a first end coupled to the left earphone assembly and a second end coupled to the right earphone assembly. The headband includes a lace. The headband further includes a tightenable apparatus disposed along a length of an inner side of the headband, the tightenable apparatus coupled to the lace and arranged to tighten or relax responsive to control of the lace. The headband further includes a cushion arranged to contact a wearer head.

In one example, a headband includes a lace. The headband includes a tightenable apparatus disposed along a length of an inner side of the headband, the tightenable apparatus coupled to the lace and arranged to tighten or relax responsive to control of the lace. The headband further includes a cushion arranged to contact a wearer head.

In one example, a headband includes a lace, a first band, and a second band. The headband includes a first slider coupled to the lace and a second slider coupled to the lace. The first slider and the second slider are moveable along a length of the first band and along a length of the second band responsive to control of the lace.

In one example, a lace pulley system runs through the headband, and is adjusted by using a cinch. The lace pulley system is embedded into the soft-goods of the headband, which is attached to a metal frame. To operate, the user squeezes the cinch and pulls the lace until the desired clamp force is reached. The inventors have recognized that approximately 1 Newton (N) of adjustment is needed between active use and leisure use. In the relaxed state, the headband provides approximately 4 N of clamping force. In the tightened state, the headband provides approximately 5 N of clamping force. The headband is mostly made of soft flexible fabric, so the headband advantageously also contours the head when cinched. This makes for an even more secure fit by bringing the headband closer to the head. Advantageously, the head-worn device gives the user control of how much clamp their headphones have. As a result, the user can cycle through multiple activities throughout their day using a single head-worn device.

Figure 2:
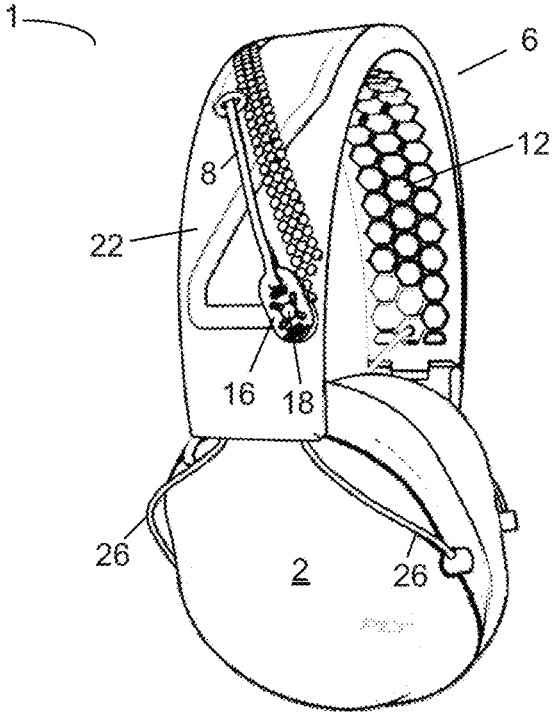
FIG. 2 illustrates a right view of the headphone shown in FIG. 1.
Figure 3:
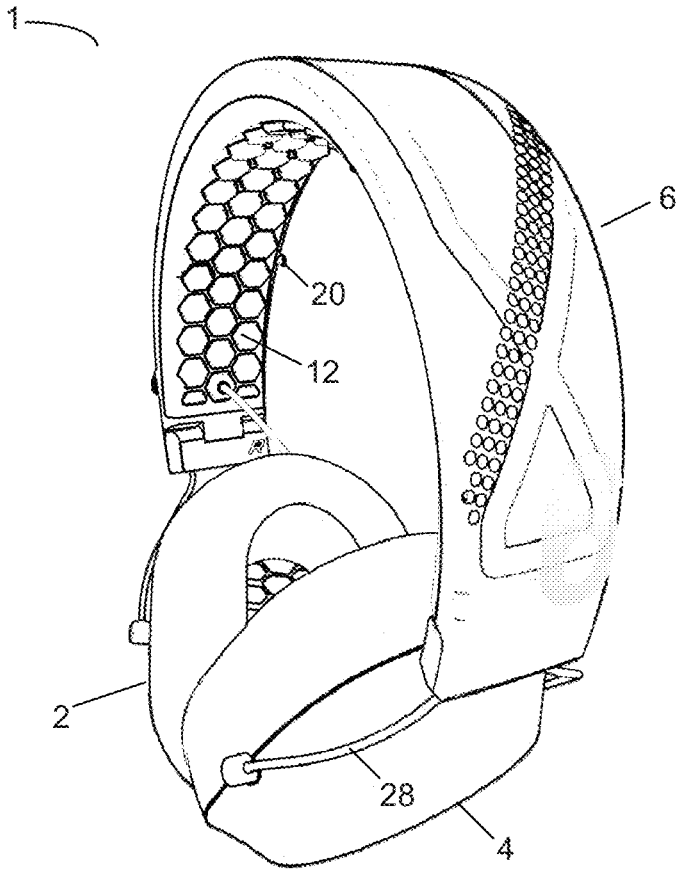
FIG. 3 illustrates a left view of the headphone shown in FIG. 1.
Figure 4:
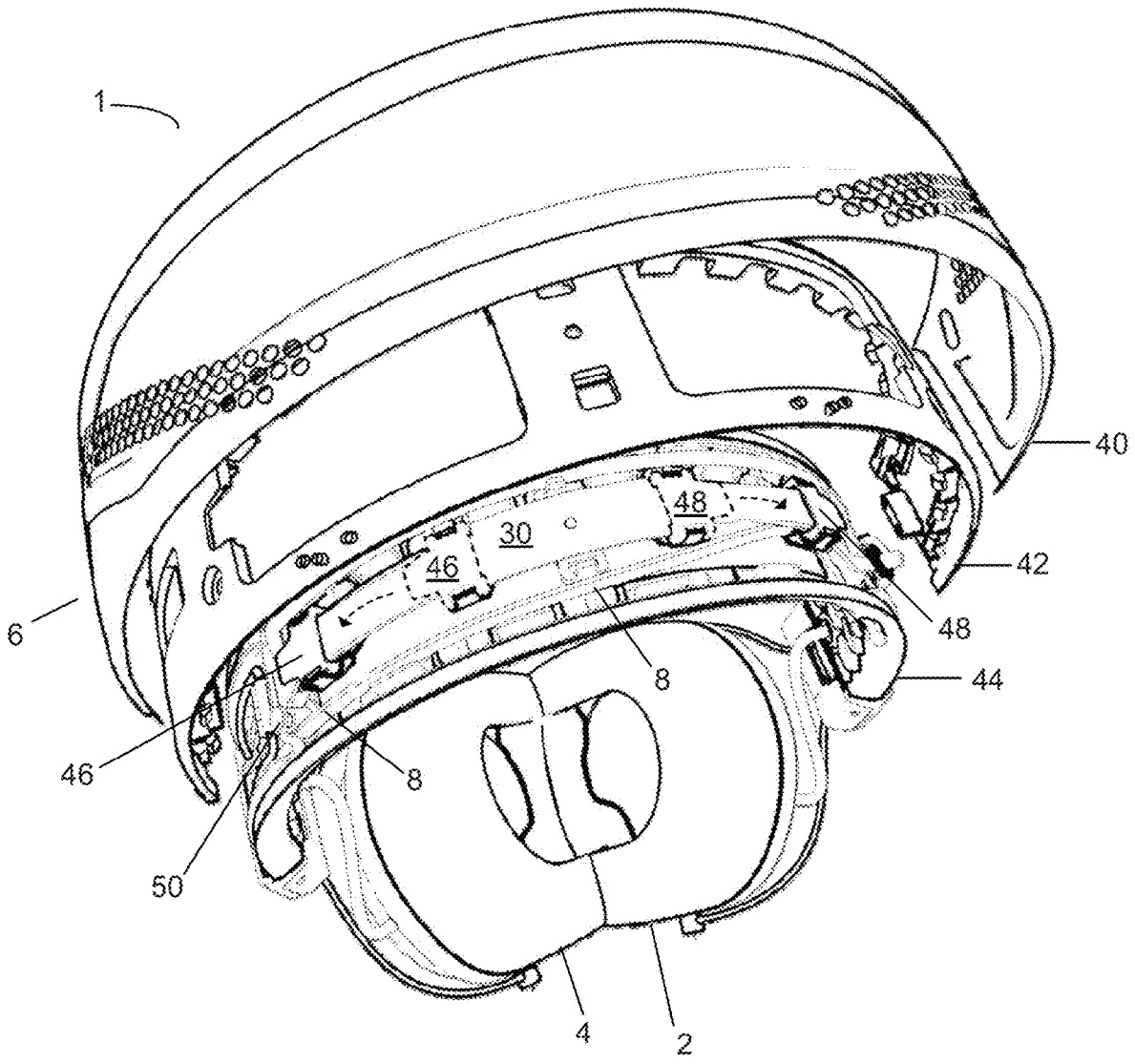
FIG. 4 illustrates an exploded top view of the headphone shown in FIG. 1.

FIG. 1 illustrates a front view of a headphone 1 with a headband having a tightenable apparatus in one example. FIG. 2 illustrates a right view of the headphone 1 and FIG. 3 illustrates a left view of the headphone 1. FIG. 4 illustrates an exploded top view of the headphone 1.

Referring to FIGS. 1-3, headphone 1 includes a right earphone assembly 2, a left earphone assembly 4, and a headband 6. Headband 6 has a first end coupled to the left earphone assembly 4 and a second end coupled to the right earphone assembly 2. Headphone 1 may also include one or more microphones.

Referring to FIG. 4, headband 6 further includes a tightenable apparatus 30 disposed along a length of an inner side 14 of the headband 6, the tightenable apparatus 30 coupled to the lace 8 and arranged to tighten or relax responsive to control of the lace 8. For example, lace 8 is made of nylon, cotton, or leather.

Referring again to FIGS. 1-3, headband 6 further includes a cushion 12 arranged to contact a wearer head. For example, cushion 12 is composed of a foam material. Cushion 12 tightens or relaxes respond to movement of the tightenable apparatus 30, contouring to the shape of the wearer head with increased tension when tightened. Cushion 12 may be covered by a material such as leather or leatherette which contacts the user head to provide user comfort when worn. Headband 6 includes a first anchor post 20 associated with a headband 6 relaxed state and a second anchor post 18 associated with a headband 6 tightened state. Handle 16 includes an aperture attachable to the first anchor post 20 or the second anchor post 18. Second anchor post 18 is located on an outer side 22 of the headband 6.

The left earphone assembly 4 is movably coupled to the headband 6 in an arrangement utilizing left earphone coupling wires 28 to move bidirectionally to provide for a left vertical length adjustment between a center (i.e., the top) of the headband 6 and the left earphone assembly 4. Similarly, the right earphone assembly 2 is movably coupled to the headband 6 in an arrangement utilizing right earphone coupling wires 26 to move bidirectionally to provide for a right vertical length adjustment between the center of the headband 6 and the right earphone assembly 2.

Left earphone coupling wires 28 and right earphone coupling wires 26 are capable of moving in an insertion direction towards the center of the headband 6 or moving in a withdrawal direction away from the center of the headband 6 to provide the desired vertical adjustment. Headband 6 includes the necessary interior tube assemblies on the left and right sides to receive the left earphone coupling wires 28 and right earphone coupling wires 26, respectively. In one example, left earphone coupling wires 28 and right earphone coupling wires 26 are rigid and formed from a metal material such as stainless steel. In operation, a user with a smaller head will position the earphone assemblies 2, 4 to decrease the distance to the top of the headband 6 while a user with a larger head will position the earphone assemblies 2, 4 to increase this distance. In further examples, alternative coupling mechanisms may be utilized providing a similar positioning/adjustment flexibility.

In a further example, the earphone assemblies 2, 4 are coupled to the headband 6 with a ball-and-socket type joint. This joint provides the earphone assemblies 2, 4 the ability for angular motion in all directions, thereby enabling them to adjust to any ear shape when placed on the user ear. The earphone assemblies 2, 4 are coupled to the headband 6 such that when worn by the user, the earphone assemblies 2, 4 are pressed against the ears with a side pressure.

Each earphone assembly 2, 4 includes an earphone (i.e., an audio transducer unit) disposed therein, and an ear cushion disposed on the outer housing for contact with the user ear when worn. The ear cushion operates both to provide comfort as well as serve the purpose of sealing around the user ear to keep in sound reproduced by the audio transducer unit. The shown left earphone assembly 4 and right earphone assembly 2 are merely one example among many which can be used with the headband 6.

FIG. 4 illustrates an exploded top view of the headphone 1 shown in FIG. 1. In the illustrated example, headband 6 is composed of several layers, including a cover layer 40, interior layer 42, and bottom layer 44. A cloth material overwrap or sleeve may be placed over headband 6. Interior layer 42 and bottom layer may be composed of any suitable material having sufficient rigidity and structure to support tightenable apparatus 30. For example, one or more of cover layer 40, interior layer 42, and bottom layer 44 may be formed from a plastic material. Cushion 12 is attached to bottom layer 44.

Figure 5:
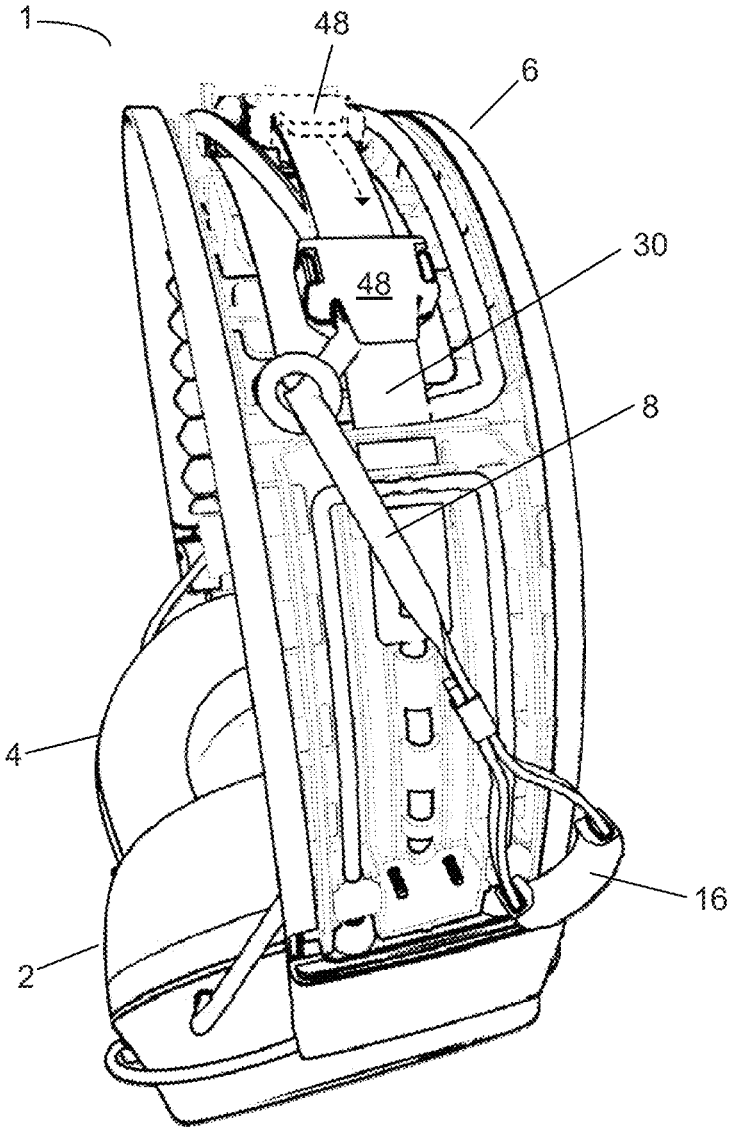
FIG. 5 illustrates a right view of the tightenable apparatus in the headphone in one example.
Figure 6:
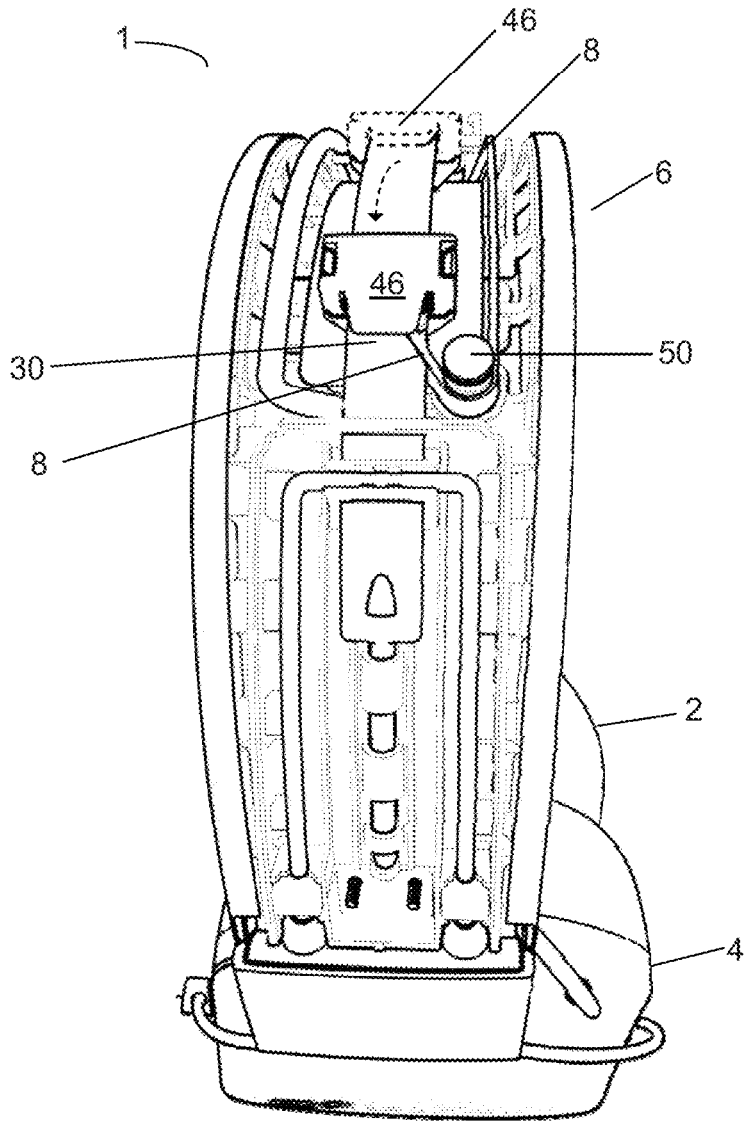
FIG. 6 illustrates a left view of the tightenable apparatus in the headphone in one example.

FIG. 5 illustrates a right view of the tightenable apparatus 30 in the headphone 1 in one example. FIG. 6 illustrates a left view of the tightenable apparatus 30. Lace 8 includes a first end coupled to the tightenable apparatus 30 and a second end coupled to a handle 16. Specifically, referring to FIG. 6, the first end of lace 8 is coupled to left slider 46 after wrapping around pulley 50. Pulley 50 operates to change the direction of force on lace 8 as user pulls or releases handle 16. Handle 16 may take a variety of form factors.

In one example operation, the headband 6 is in a relaxed state whereby handle 16 is coupled to first anchor post 20. To increase the tension (i.e., clamping force) of the headband 6 on the wearer head, the user removes handle 16 from first anchor post 20 and pulls handle 16 down towards anchor post 18, and attaches handle 16 to second anchor post 18 to place the headband 6 in a tightened state. During this operation, lace 8 controls the movement of left slider 46 and right slider 48 as the user operates handle 16. In one example, the user performs this operation prior to placing the headphone 1 on the head. Alternatively, the user may perform this operation after the headphone 1 is placed on the head. To reduce the tension of the headband 6 on the wearer head, the user performs the process in reverse, i.e., removes handle 16 from second anchor post 18 and attaches it to first anchor post 20.

As shown in FIG. 6, left slider 46 is initially in a first position (indicated by dotted lines) during the relaxed state. As the user pulls handle 16 downwards, the left slider 46 moves in a downward direction as lace 8 pulls the left slider 46 downward utilizing pulley 50. Left slider 46 ultimately reaches a tightened state position as shown in FIG. 6 responsive to user pulling handle 16 from the relaxed state position to the tightened state position. Right slider 48 operates simultaneously in a similar manner to increase tension on the right side of the headband 6. As shown in FIG. 5, right slider 48 is initially in a first position (indicated by dotted lines) during the relaxed state. As the user pulls handle 16 downwards, the right slider 48 moves in a downward direction as lace 8 pulls the right slider 48 downward. Right slider 48 ultimately reaches a tightened state position as shown in FIG. 5 responsive to user pulling handle 16 from the relaxed state position to the tightened state position.

Figure 9A:
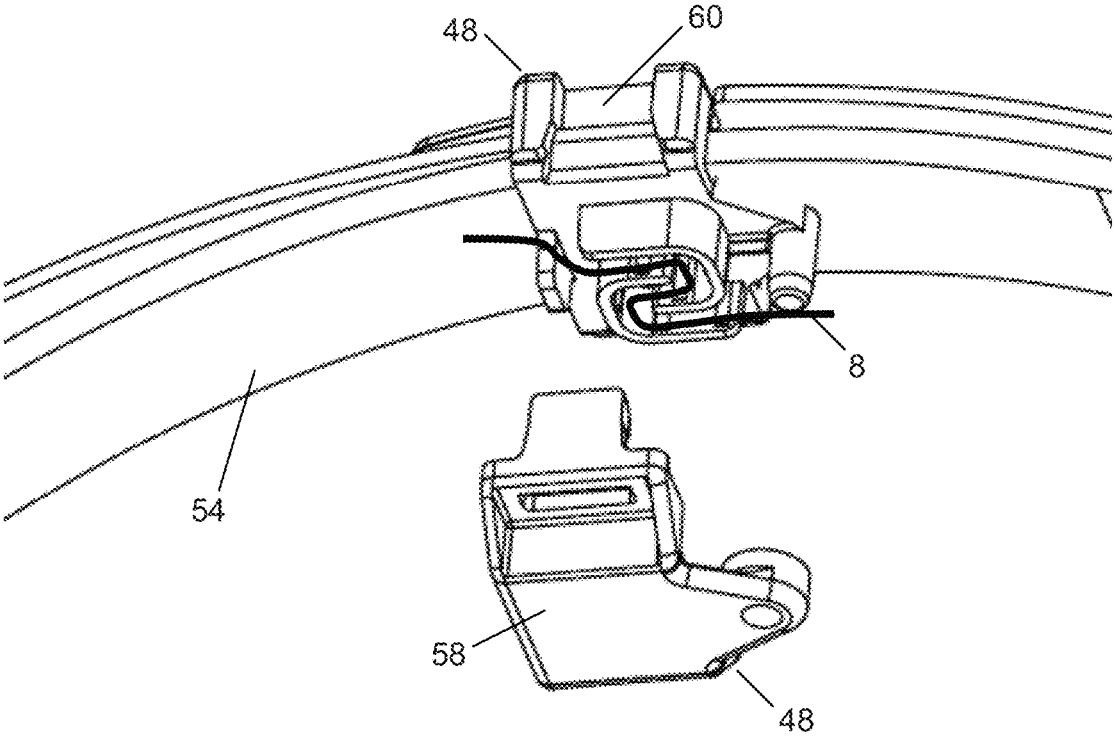
FIG. 9A illustrates a disassembled slider in one example.
Figure 9B:
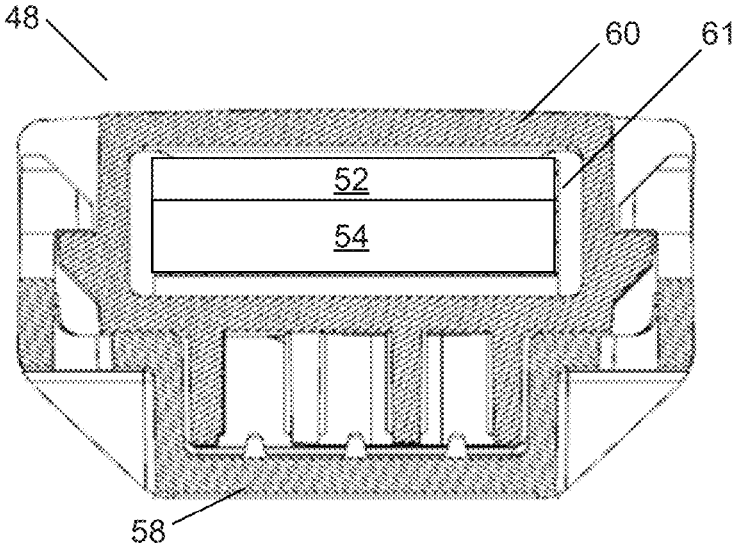
FIG. 9B illustrates a cross-sectional view of a slider with a first band and a second band disposed within an aperture.

FIG. 9A illustrates a disassembled right slider 48 in one example. Right slider 48 includes a cover component 58 and body component 60. Body component 60 is moveable along first band 52 and second band 54. For example, body component 60 includes an aperture 61 through which first band 52 and second band 54 pass through. FIG. 9B illustrates a cross-sectional view of right slider 48 with first band 52 and second band 54 disposed within aperture 61. Lace 8 (simplified diagram illustrated) is coupled to right slider 48. For example, cover component 58 and body component 60 may be formed from a plastic material.

Figure 7A:
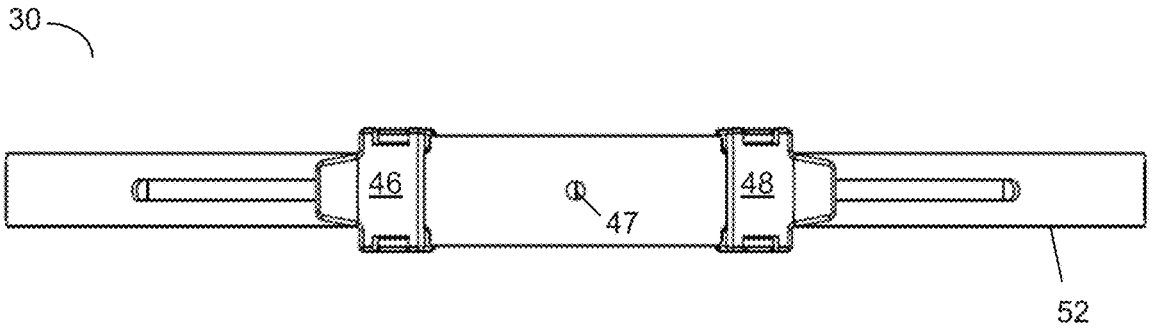
FIGS. 7A-7D illustrate a top view, side view, bottom view, and perspective view, respectively, of the tightenable apparatus in a relaxed state.
Figure 7B:
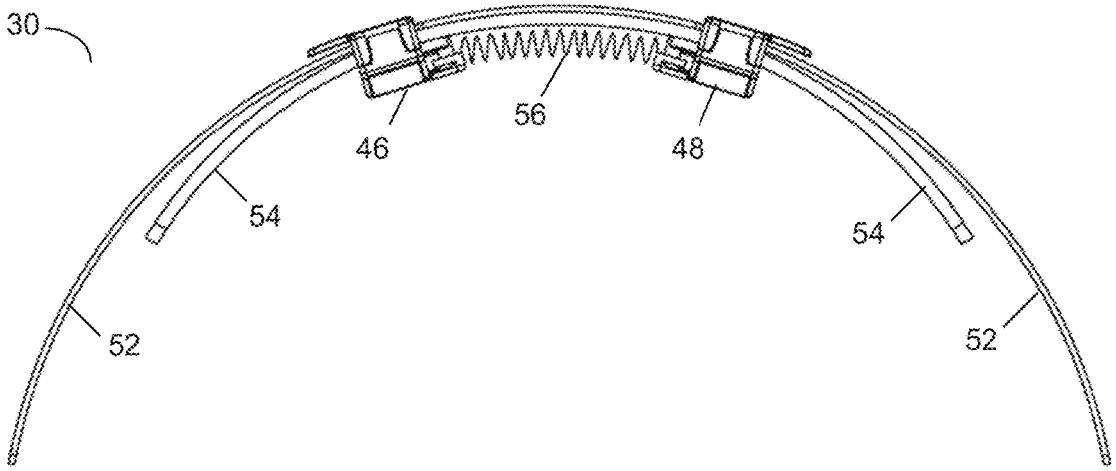
Figure 7C:
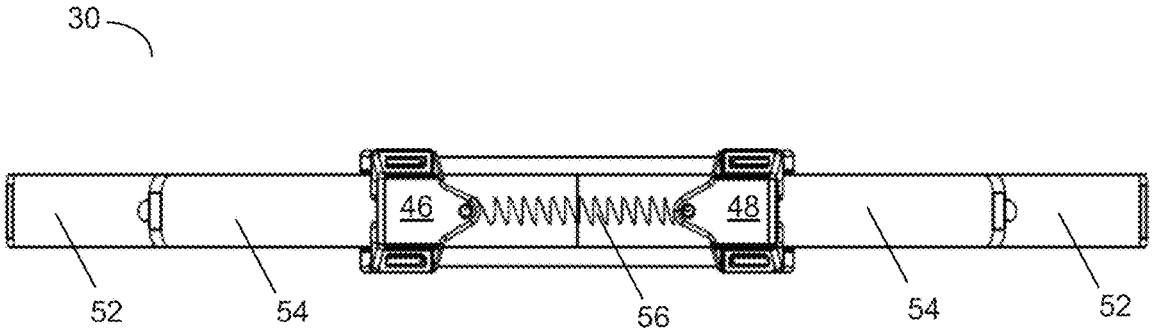
Figure 7D:
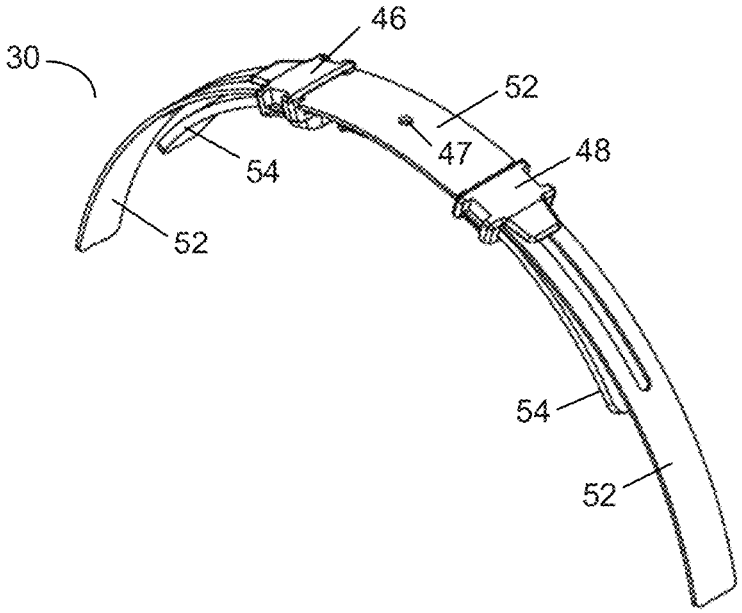
Figure 7E:
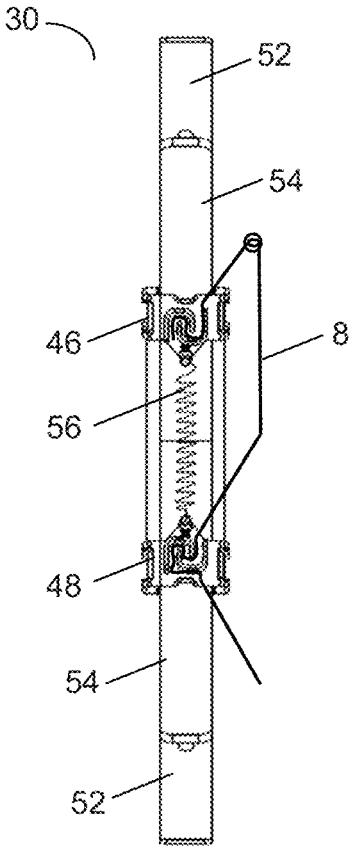
FIG. 7E illustrates a bottom view of the tightenable apparatus in a relaxed state with the controlling lace attached to the sliders.

FIGS. 7A-7D illustrate a top view, side view, bottom view, and perspective view, respectively, of the tightenable apparatus 30 in a relaxed state. FIG. 7E illustrates a bottom view of the tightenable apparatus 30 in a relaxed state with the controlling lace 8 (simplified diagram illustrated) attached to the sliders.

Referring to FIGS. 7A-7E, tightenable apparatus 30 includes a first band 52, a second band 54, a left slider 46 coupled to the lace 8, and a right slider 48 coupled to the lace 8. The left slider 46 and the right slider 48 are moveable along a length of the first band 52 and along a length of the second band 54 to tighten or relax the tightenable apparatus 30 responsive to control of the lace 8. A first end of the lace 8 is coupled to the left slider 46. The first band 52 is coupled to the second band 54. In one embodiment, first band 52 and a second band 54 are arcuate shaped and placed concentric with respect to each other, aligning an aperture 47 in each band. First band 52 and second band 54 may be coupled utilizing a coupling pin inserted through aperture 47. A spring 56 is coupled between the left slider 46 and the right slider 48.

The first band 52 has a first length having a first curvature. Second band 54 has a second length having a second curvature. The second length is different from the first length and the second curvature different from the first curvature. The first band 52 is thinner and more flexible (i.e., lower stiffness) than the second band 54. The second band 54 has a higher curvature than the first band 52, and is less flexible (i.e., greater stiffness) than first band 52. In one example, first band 52 and second band 54 are composed of a metal such as stainless steel having a surface hardness of approximately 450-480 Vickers Pyramid Number (HV). In one example, first band 52 has a length of 176.1 mm, a thickness of 0.7 mm, and a curvature between zero and 0.016 $m^{-1}$. Second band 54 has a length of 113.8 mm, a thickness of 1.5 mm, and a curvature between zero and 0.0163 $m^{-1}$. In further example, a plastic material having substantially similar properties may be utilized.

Figure 8A:
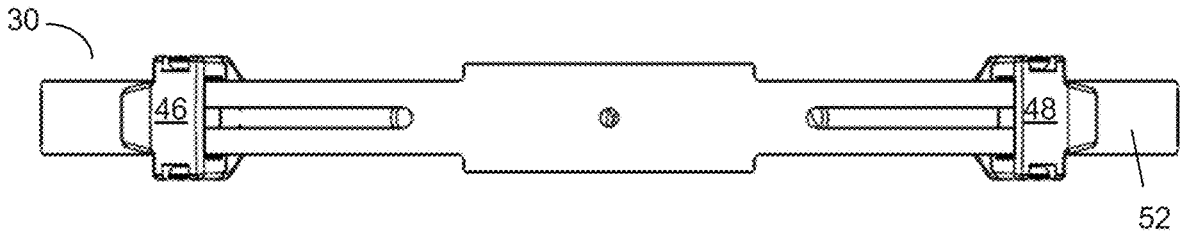
FIGS. 8A-8D illustrate a top view, side view, bottom view, and perspective view, respectively, of the tightenable apparatus in a tightened state.
Figure 8B:
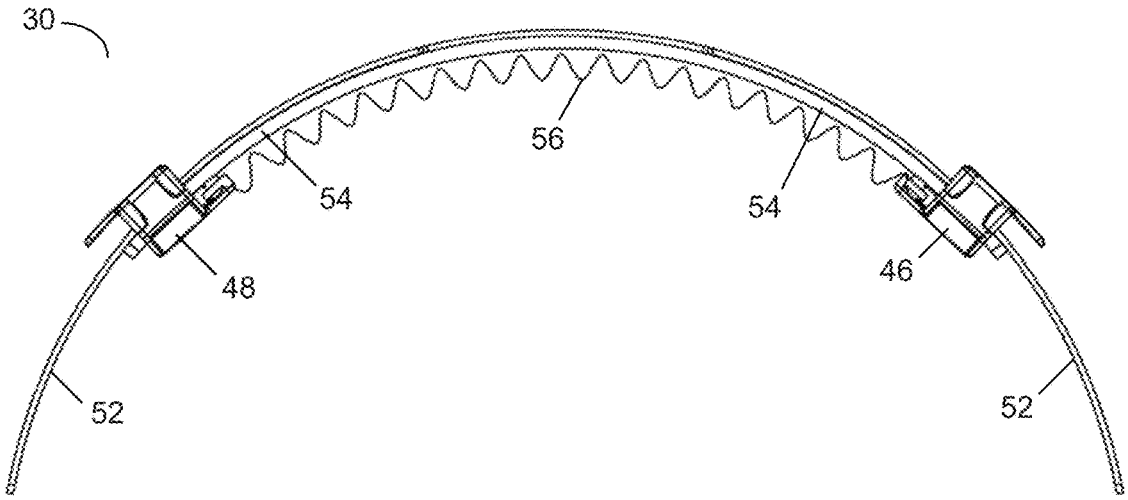
Figure 8C:
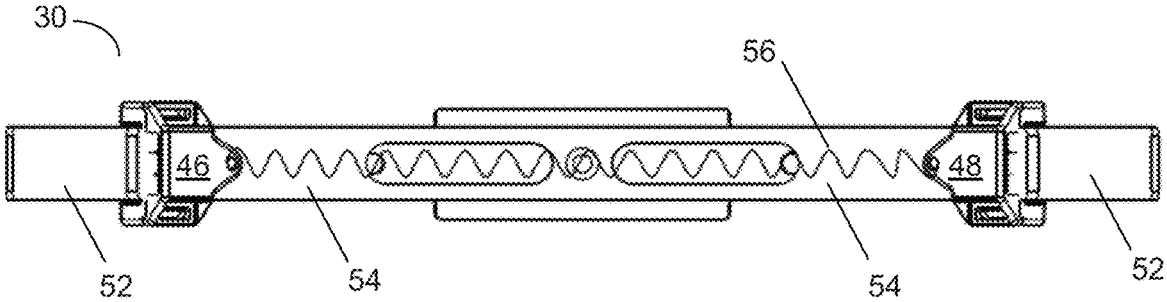
Figure 8D:
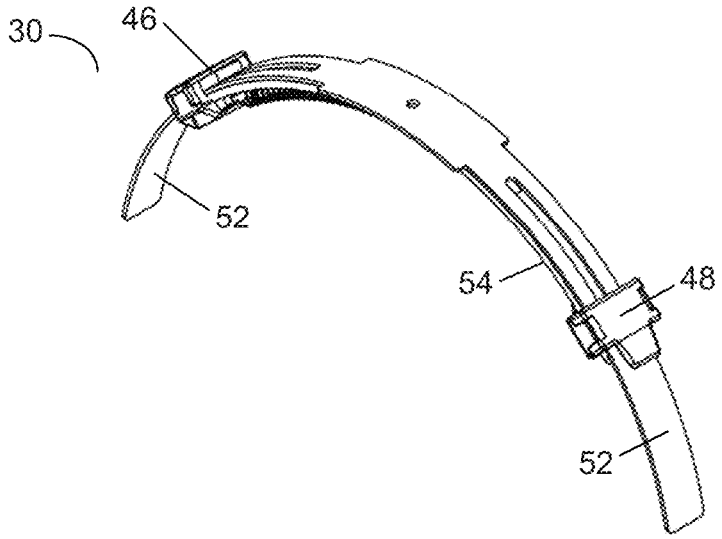
Figure 8E:
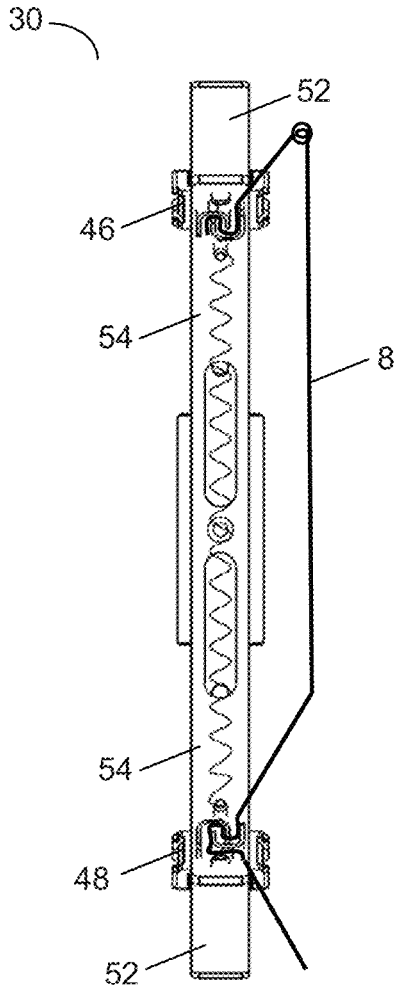
FIG. 8E illustrates a bottom view of the tightenable apparatus in a tightened state with the controlling lace attached to the sliders.

In operation, when the left slider 46 and right slider 48 are moved downward (i.e., towards left earphone assembly 4 and right earphone assembly 2, respectively) during transition from the relaxed state to the tightened state, the first band 52 bends downward to match the curvature of the second band 54 because the first band 52 is more flexible. As a result, the tension of headband 6 on the user head (i.e., clamping force) is increased. Spring 56 stretches to extend while the headband transitions to the tightened state. By increasing the clamp force of the headband 6, the headband 6 is optimized for active use. FIGS. 8A-8D illustrate a top view, side view, bottom view, and perspective view, respectively, of the tightenable apparatus 30 in a tightened state. FIG. 8E illustrates a bottom view of the tightenable apparatus 30 in a tightened state with the controlling lace attached to the sliders.

The opposite process occurs during a transition from the tightened state to the relaxed state. With the assistance of the spring force provided by spring 56 contracting, left slider 46 and right slider 48 move upward (i.e., away from left earphone assembly 4 and right earphone assembly 2, respectively) during transition from the tightened state to the relaxed state. This causes first band 52 to return to its original unloaded curvature, no longer matching the curvature of the second band 54. As a result, the clamping force of headband 6 on the user head is decreased. Spring 56 tightens to its unloaded state when the headband transitions to the relaxed state. By decreasing the clamp force of the headband 6, the headband 6 is optimized for comfort and leisure use.

Figure 11A:
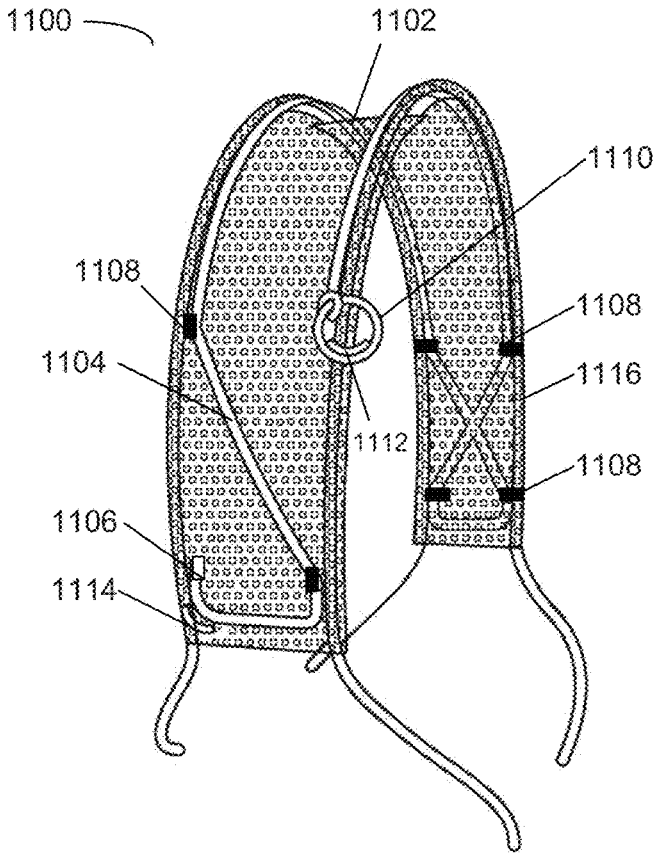
FIG. 11A is a simplified diagram of a tightenable apparatus in a further example illustrating a cinching arrangement of a lace on elastic material in a relaxed state.
Figure 11B:
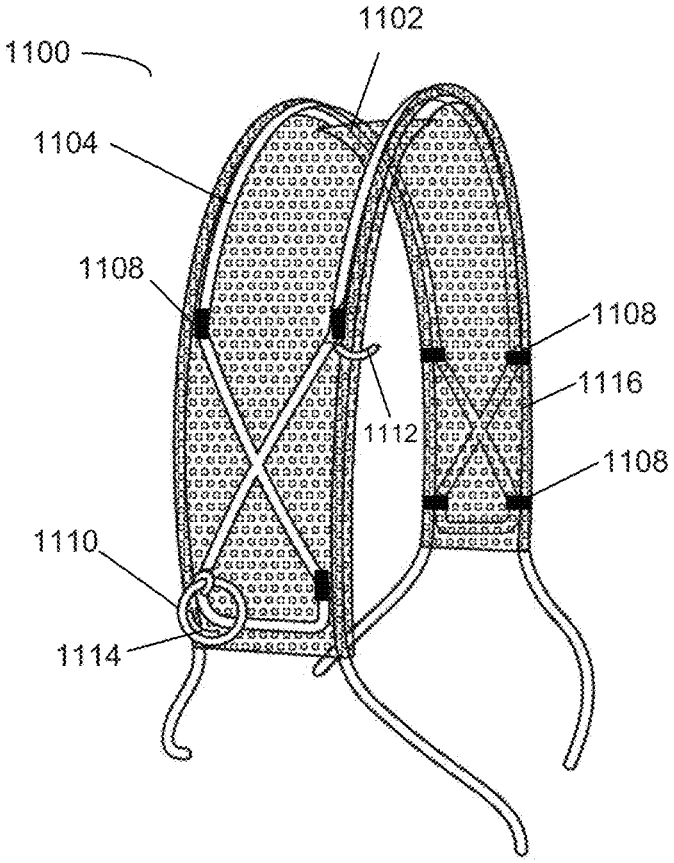
FIG. 11B is a simplified diagram illustrating the tightenable apparatus shown in FIG. 11A in a tightened state.

FIG. 11A is a simplified diagram of a tightenable apparatus 1100 for use with headband 6 illustrating a cinching arrangement of a lace 1104 on an elastic (i.e., stretchable) material 1102 in a relaxed state in a further example. A first end of lace 1104 is fixedly attached at position 1106. Lace 1104 is slideably attached at cinching positions 1108 along a frame 1116. A second end of lace 1104 is attached to handle 1110. During the relaxed state, handle 1110 positioned on an anchor 1112. To cinch the tightenable apparatus 1100, the user pulls handle 1110 and places it on an anchor 1114. FIG. 11B is a simplified diagram of the tightenable apparatus 1100 in a tightened state.

Figure 10B:
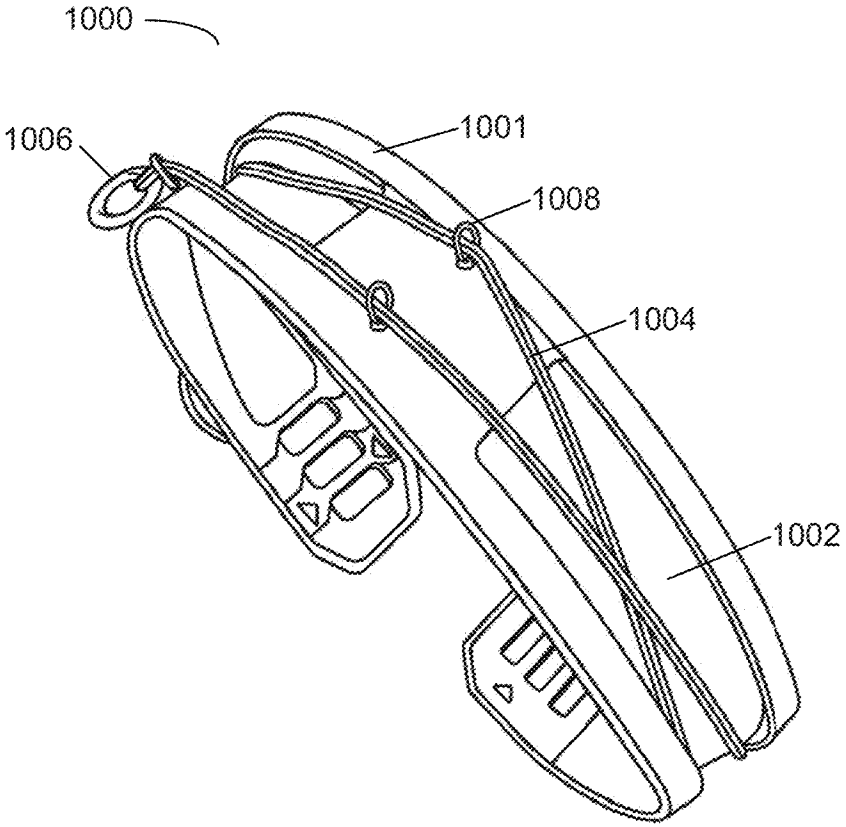
FIGS. 10A-10C illustrate a right view, top view, and left view, respectively, of a tightenable apparatus for use with a headband in a further example, the tightenable apparatus shown in a relaxed state.
Figure 10A:
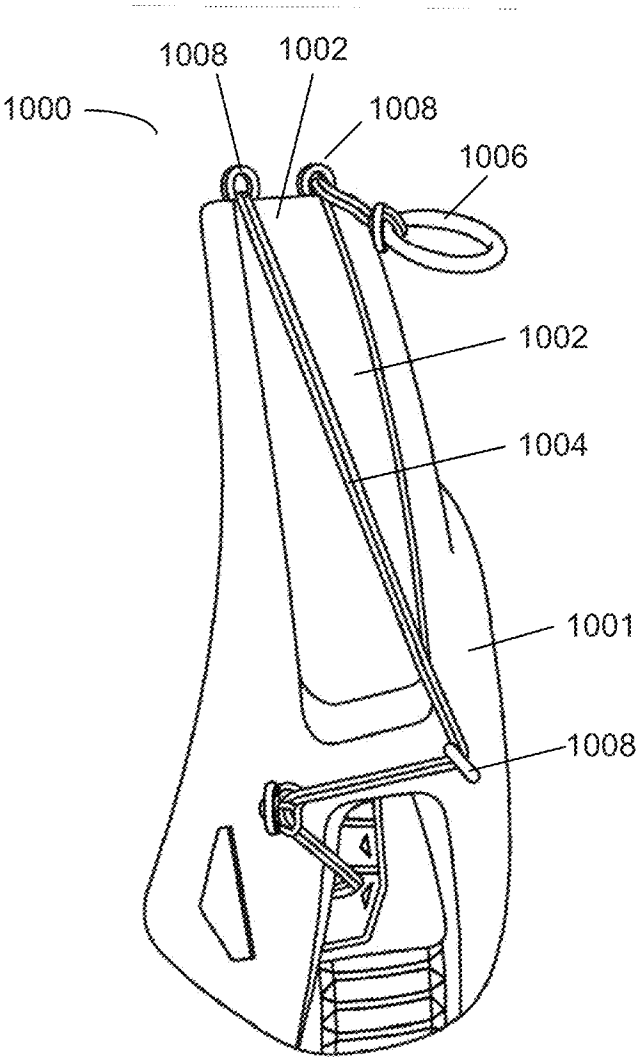
Figure 10D:
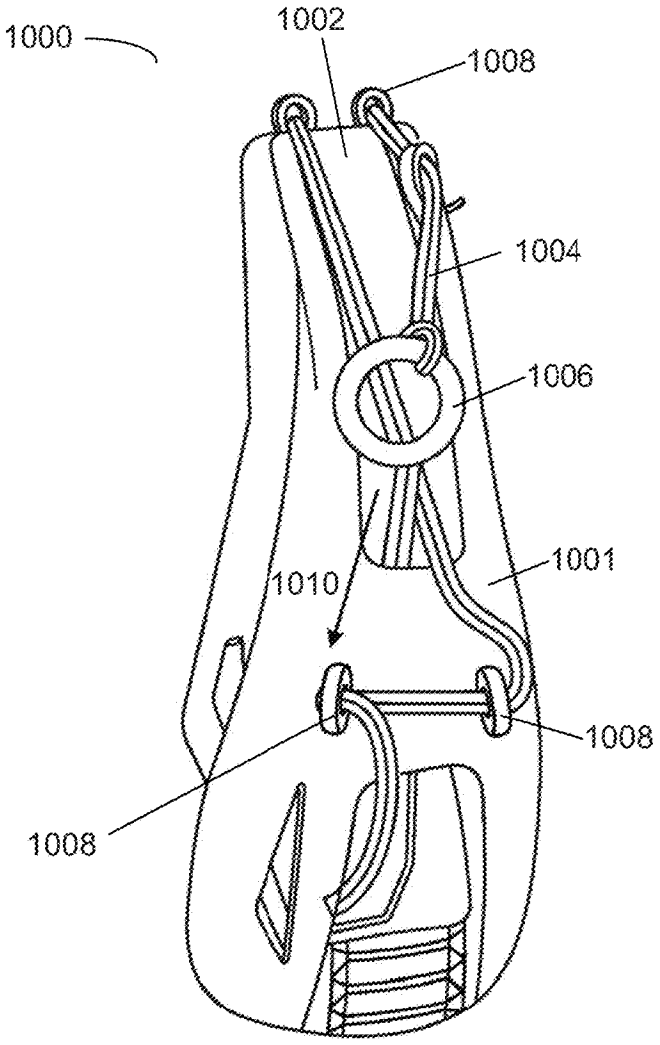
FIG. 10D illustrates the headband with the tightenable apparatus shown in FIGS. 10A-10C in operation in transition between a relaxed state and a tightened state.
Figure 10C:
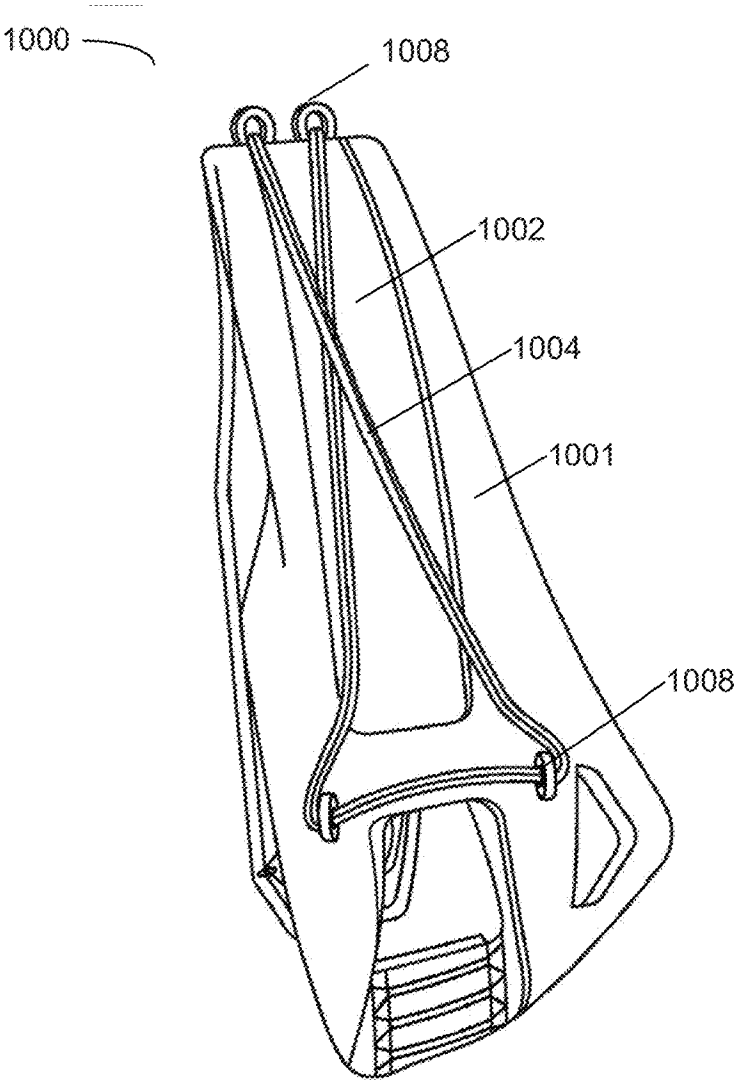

FIGS. 10A-10C illustrate a right view, top view, and left view, respectively, of a tightenable apparatus 1000 for use with headband 6 in a further example, the tightenable apparatus 1000 shown in a relaxed state. The tightenable apparatus 1000 includes an elastic (e.g., stretchable) material 1002 attached to a headband frame 1001, the elastic material 1002 arranged to tighten or relax responsive to control of a lace 1004. Elastic material 1002 is pulled/lengthened when the user pulls lace 1004, exerting tension, and returns to its former shape/length when the user releases lace 1004. In one example, elastic material 1002 is an elastomer having highly elastic properties. For example, elastic material 1002 is a woven elastic fabric.

The lace 1004 includes a first end attached to the headband frame 1001 and a second end coupled to a handle 1006, the handle 1006 attachable to an anchor post disposed on an outer surface of the headband frame 1001. Lace 1004 is attached at select locations on the headband frame 1001 utilizing guide members 1008 in a manner that allow the lace 1004 to slide through the guide members 1008. For example, the guide members 1008 are rings through which lace 1004 pass. At least a portion of the lace 1004 is disposed on a surface of the elastic material 1002 in a cinching arrangement so that lace 1004 may cinch elastic material 1002.

Figure 10E:
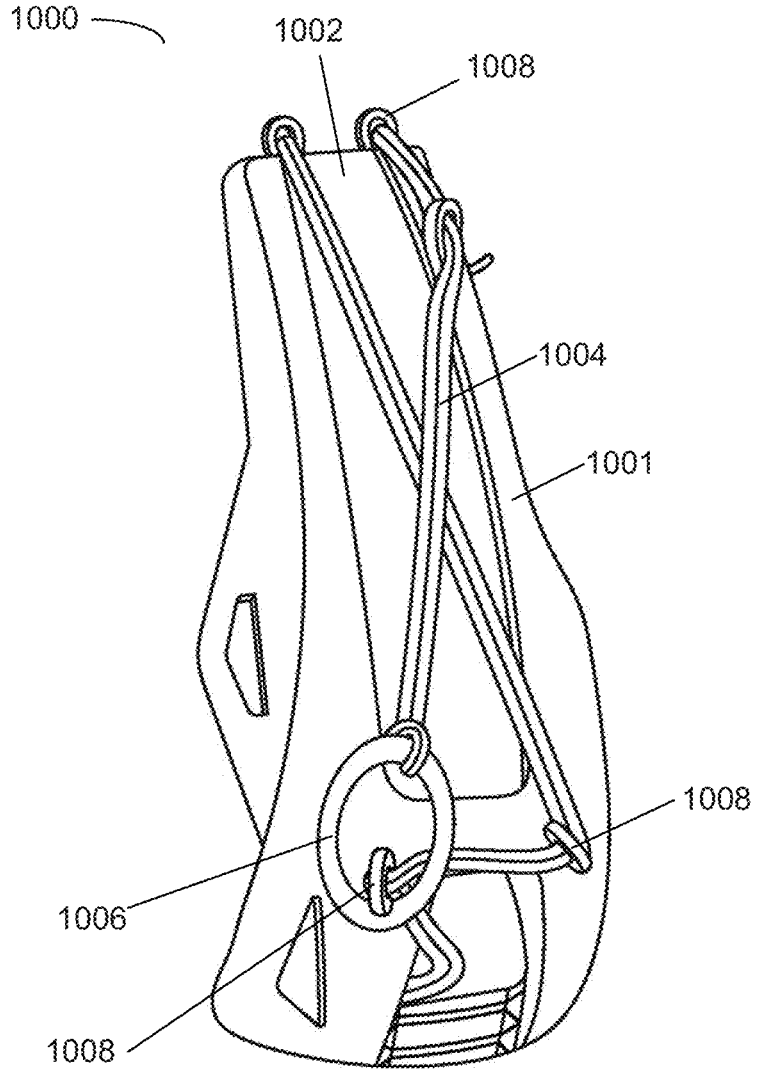
FIG. 10E illustrates the headband with the tightenable apparatus shown in FIGS. 10A-10C in a tightened state.

FIG. 10D illustrates the tightenable apparatus 1000 in operation in transition between a relaxed state and a tightened state. In operation, when handle 1006 is pulled in downward direction 1010 during transition from the relaxed state to the tightened state, the lace 1004 cinches on elastic material 1002. As a result, the tension of headband 6 on the user head (i.e., clamping force) is increased. By increasing the clamp force of the headband 6, the headband 6 is optimized for active use. FIG. 10E illustrates the tightenable apparatus 1000 in a tightened state. As shown in FIG. 10E, the user has cinched elastic material 1002 by attaching handle 1006 to a tightened state anchor post (e.g., a selectively positioned guide member 1008).

The opposite process occurs during a transition from the tightened state to the relaxed state. The user removes handle 1006 from the tightened state anchor post and returns it to its relaxed state position. This causes the cinch on elastic material 1002 to be released and the elastic material 1002 returns to its original unloaded tension. As a result, the clamping force of headband 6 on the user head is decreased. By decreasing the clamp force of the headband 6, the headband 6 is optimized for comfort and leisure use.

While the exemplary embodiments of the present invention are described and illustrated herein, it will be appreciated that they are merely illustrative and that modifications can be made to these embodiments without departing from the spirit and scope of the invention. Certain examples described utilize headphones which are particularly advantageous for the reasons described herein. In some instances, not all acts may be required to be implemented in a methodology described herein.

Thus, the scope of the invention is intended to be defined only in terms of the following claims as may be amended, with each claim being expressly incorporated into this Description of Specific Embodiments as an embodiment of the invention.

What is claimed is:

1. A head-worn device comprising:
a left earphone assembly;
a right earphone assembly;
a headband having a first end coupled to the left earphone assembly and a second end coupled to the right earphone assembly, the headband comprising:
a lace;
a tightenable apparatus disposed along a length of an inner side of the headband, the tightenable apparatus coupled to the lace and arranged to tighten or relax responsive to control of the lace, wherein the lace comprises a first lace end coupled to the tightenable apparatus and a second lace end coupled to a handle;
a first anchor post associated with a headband relaxed state and a second anchor post associated with a headband tightened state, wherein the handle comprises an aperture attachable to the first anchor post or the second anchor post; and
a cushion arranged to contact a wearer head.

2. The head-worn device of claim 1, wherein the tightenable apparatus
comprises:
a first band;
a second band;
a first slider coupled to the lace; and
a second slider coupled to the lace, the first slider and the second slider moveable along the first band and along the second band to tighten or relax the tightenable apparatus responsive to control of the lace.

3. The head-worn device of claim 2, further comprising a spring coupled between the first slider and the second slider.

4. The head-worn device of claim 2, wherein the first band comprises a first length having a first curvature and the second band comprises a second length having a second curvature, the second length different from the first length and the second curvature different from the first curvature.

5. The head-worn device of claim 1, wherein the tightenable apparatus comprises:
an elastic material arranged to tighten or relax responsive to control of the lace.

6. The head-worn device of claim 5, wherein at least a portion of the lace is disposed on a surface of the elastic material.

7. A headband comprising:
a lace;
a tightenable apparatus disposed along a length of an inner side of the headband, the tightenable apparatus coupled to the lace and arranged to tighten or relax responsive to control of the lace, wherein the lace comprises a first end coupled to the tightenable apparatus and a second end coupled to a handle;
a first anchor post associated with a headband relaxed state and a second anchor post associated with a headband tightened state, wherein the handle comprises an aperture attachable to the first anchor post or the second anchor post; and
a cushion arranged to contact a wearer head.

8. The headband of claim 7, wherein the tightenable apparatus comprises:
a first band;
a second band;
a first slider coupled to the lace; and
a second slider coupled to the lace, the first slider and the second slider moveable along the first band and along the second band to tighten or relax the tightenable apparatus responsive to control of the lace.

9. The headband of claim 8, further comprising a spring coupled between the first slider and the second slider.

10. The headband of claim 8, wherein the first band comprises a first length having a first curvature and the second band comprises a second length having a second curvature, the second length different from the first length and the second curvature different from the first curvature.

11. The headband of claim 7, wherein the tightenable apparatus comprises:
an elastic material, the elastic material arranged to tighten or relax responsive to control of the lace.

12. A headband comprising:
a lace;
a first band;
a second band;
a first slider coupled to the lace;
a second slider coupled to the lace, the first slider and the second slider moveable along the first band and along the second band responsive to control of the lace, wherein the lace comprises a first end coupled to the first slider and a second end coupled to a handle; and
a first anchor post associated with a headband relaxed state and a second anchor post associated with a headband tightened state, wherein the handle comprises an aperture attachable to the first anchor post or the second anchor post.

13. The headband of claim 12, further comprising a spring coupled between the first slider and the second slider.

14. The headband of claim 12, wherein the first band comprises a first length having a first curvature and the second band comprises a second length having a second curvature, the second length different from the first length and the second curvature different from the first curvature.

* * * * *